United States Patent [19]

Zimmer

[11] 3,993,022

[45] Nov. 23, 1976

[54] APPARATUS FOR REMOVING FERROUS PARTICULATE MATTER FROM COPY PAPER IN AN ELECTROSTATIC COPIER

[75] Inventor: Robert E. Zimmer, Niles, Ill.

[73] Assignee: Addressograph Multigraph Corporation, Cleveland, Ohio

[22] Filed: Aug. 1, 1975

[21] Appl. No.: 601,389

[52] U.S. Cl. ..... 118/652; 427/18

[51] Int. Cl.[2] ..... G03G 13/08

[58] Field of Search ..... 118/637, DIG. 24; 427/13, 18; 355/15

[56] References Cited

UNITED STATES PATENTS

| | | | |
|---|---|---|---|
| 3,457,900 | 7/1969 | Drexler | 118/637 |
| 3,678,895 | 7/1972 | Ohta et al. | 118/637 |
| 3,739,749 | 6/1973 | Kangas et al. | 118/637 |
| 3,894,513 | 7/1975 | Stanley et al. | 118/637 |
| 3,901,187 | 8/1975 | Hudson | 118/637 |

*Primary Examiner*—Henry S. Jaudon

[57] ABSTRACT

Apparatus and method for continuously removing ferrous particulate matter from an image bearing element being transported along a predetermined path in an electrostatic copying machine.

Ferrous particulate matter is magnetically attracted away from the element as it moves along its path. A receiver, preferably movable on an endless path, receives the particulate matter attracted away from the element and conveys the particulate matter to a predetermined location.

1 Claim, 1 Drawing Figure

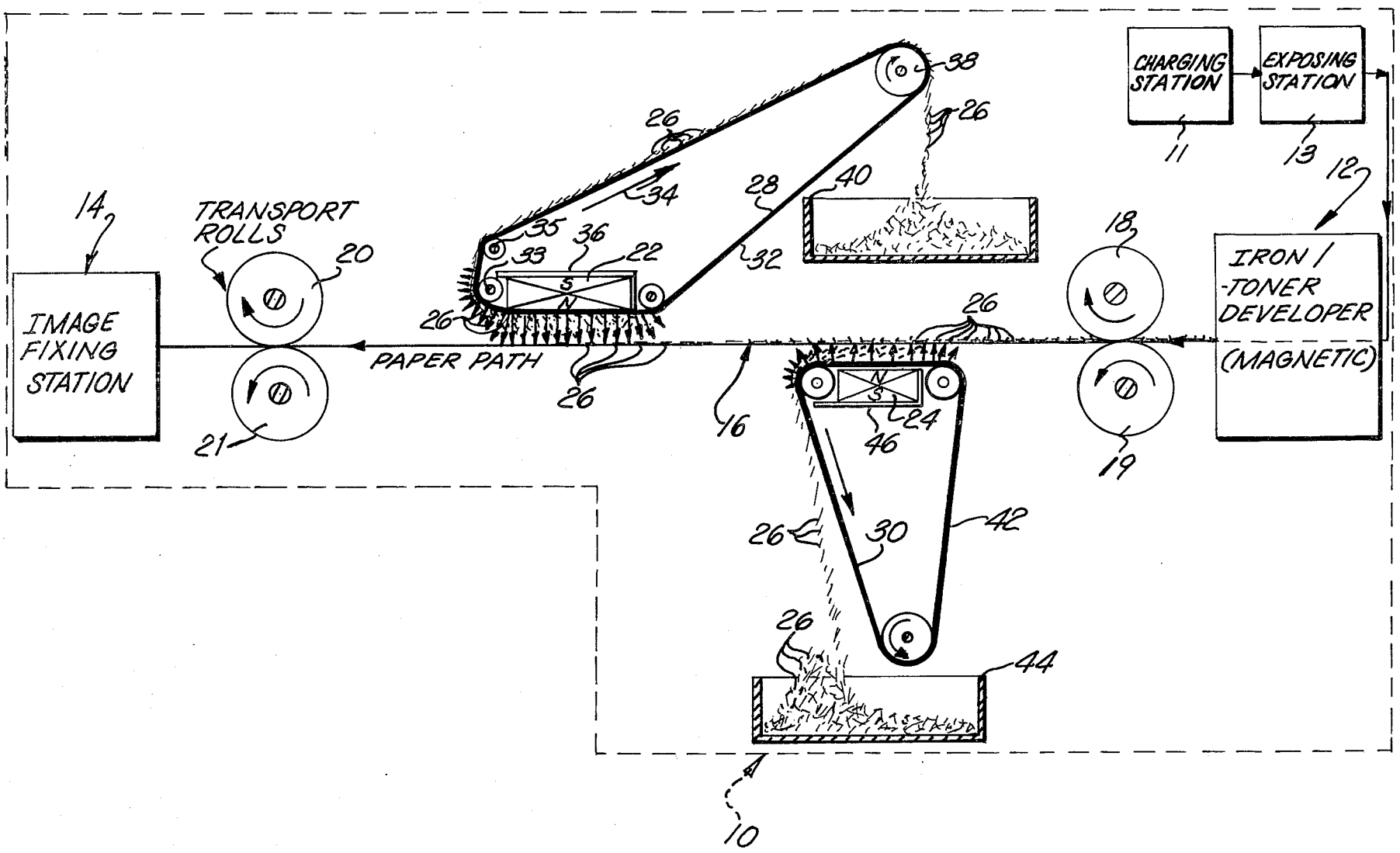
CHARGING STATION
11
EXPOSING STATION
13
12
IRON / TONER DEVELOPER (MAGNETIC)
18
19
38
26
40
28
32
34
35
33
36
22
24
46
30
42
44
16
10
PAPER PATH
TRANSPORT ROLLS
20
21
14
IMAGE FIXING STATION

APPARATUS FOR REMOVING FERROUS PARTICULATE MATTER FROM COPY PAPER IN AN ELECTROSTATIC COPIER

BACKGROUND OF THE INVENTION

The present invention relates to electrostatic copiers of the type which employ a magnetic brush developer for applying toner to a charged photoconductive member, and particularly, to an apparatus and method for removing unwanted ferrous particulate material which remains with an imaged element as it is transported along a predetermined path within the copier. It has been conventional to locate a magnet in close proximity to the path of such an element and to attract the ferrous particulate material from the element to the magnet. The ferrous particulate matter is then periodically manually removed from the face of the magnet at appropriate intervals.

An alternate way of removing these particles, when they are to be removed from the lower surface of a photoconductive member, is shown in U.S. Pat. No. 3,457,900, in which the cleaning magnet is surrounded by a rigid rotating cylinder which deflects the particles away from the magnet and allows them to fall into a sump.

SUMMARY OF THE PRESENT INVENTION

According to the present invention, a magnetic field is created about a portion of the element as it is being transported along the predetermined path, the magnetic field being of sufficient strength to draw ferrous particulate matter away from the element. A receiver is provided with a first portion located in the magnetic field and adapted to intercept and collect the ferrous particulate matter drawn away from the element. The first portion of the receiver is moved out of the magnetic field and transports the collected ferrous particulate matter with it to a predetermined location and a second portion of the receiver is moved into the magnetic field to continue the collection of ferrous particulate matter being drawn away from the element. At the predetermined location, the particulate matter is deposited into a collection station for subsequent removal.

The receiver in this case is an endless flexible member trained over a series of guides or rollers and serves as a conveyor for transporting the removed particles to a remote location within the machine for convenient accumulation. To this end the flexible member has a textured surface which allows it to temporarily trap the particles and insure their movement away from the magnetic field area.

Thus, the principal object of the present invention is to provide an apparatus and method for collecting unwanted ferrous particulate matter from an image bearing element being transported along a predetermined path within an electrostatic copier, and transporting the removed ferrous particulate matter to a predetermined remote location.

Other objects and advantages of the present invention will become further clear from the following description and the accompanying drawings wherein:

DESCRIPTION OF THE DRAWINGS

The single FIGURE of the drawing is a schematic illustration of the apparatus for removing ferrous particulate matter from sheet material according to the present invention.

DETAILED DESCRIPTION OF THE INVENTION

As set forth above, the present invention relates to the removal of ferrous particulate matter from an image bearing element being moved along a predetermined path within an electrostatic copier. There is described hereinafter the preferred embodiments of the method and apparatus for accomplishing this result. It is believed that from the description which follows, numerous obvious modifications of these embodiments, which employ the principles of the present invention, will become readily apparent to those of ordinary skill in the art.

In the type of electrostatic copier schematically represented at 10 in the drawing, copy paper carrying a photoconductive layer is electrostatically charged at a charging station 11 so that its surface becomes photosensitive. The charged paper then passes to an exposing station 13 at which the charge on the non-image areas of the photosensitive surface is dissipated. The paper then passes to a magnetic developer station 12 at which toner material is applied to the charged image areas of the sheet of paper to make the image visible. The paper is then transported away from the magnetic developer and to an image fixing station 14 where the image is fixed by heat, pressure or other conventional fixing means. Thereafter, the paper is dispensed from the copier.

Another conventional type of electrostatic copier provides a developing station wherein a photoconductor in the form of an electrostatically charged belt or drum surface receives an image and transports the image to a transfer station where it transfers the image to a copy sheet. The copy sheet is then transported to an image fixing station and then ejected from the machine. Such forms of electrostatic copiers are conventional to the copying art and need not be described in any further detail.

It will be understood that the arrangement to be described can be put to use either adjacent the path of an image bearing photoconductive copy sheet element or a photoconductive belt or drum element as it transports the image from the magnetic brush developing station to the fixing station, or adjacent the path of an image receiving copy sheet as it travels between the transfer station and the fixing station.

The present invention relates to the removal of ferrous particulate matter from any such element as it travels between the magnetic developer station and the image fixing or transfer station of an electrostatic copier, or between the transfer station and fixing station of an electrostatic copier. For illustration purposes, the following description relates to an electrostatic copier of the type represented by FIG. 1 wherein the element is shown as a copy sheet with a photoconductive layer.

In the drawing, there is shown at 16 a paper path from the magnetic developer to the image fixing station 14. A pair of transport rolls 18, 19 and a second pair of transport rolls 20, 21 serve to guide the paper between the magnetic developer and the image fixing station. It will be recognized by those of ordinary skill in the art that the details of the paper path and the mechanisms for guiding the paper along the path may vary according to the particular type of electrostatic copier being used.

The magnetic developer station 12 is of a conventional type which includes a magnetic brush made up of ferrous carrier particles magnetically constituted into bristles, which brush serves to apply toner material carried thereby to a sheet of charged paper. During the application of the toner, pieces of ferrous particulate matter from the magnetic brushes sometimes tend to separate from the brush and adhere randomly to the charged sheet of paper. These particles, if not removed from the paper, can cause numerous problems to the system and degrade the quality and acceptability of the issuing copy.

According to the present invention, ferrous particulate matter is magnetically drawn away from the paper after it leaves the magnetic developer. In the embodiment shown in the drawing, a pair of magnets 22, 24 are exposed to opposite sides of a copy sheet moving along the paper path 16. Each of the magnets is fixedly supported at a location along the paper path 16. The distance of a respective magnet from the paper path, and the magnetic field of the magnet are such that the magnetic field is created around the paper moving along the paper path and is strong enough to draw ferrous particulate matter 26 away from the respective side of the paper and toward the magnet.

Normally only a single magnet would be used, placed so as to face whichever surface of the sheet carries the image, but the present illustration shows a magnet arrangement for each face in order to illustrate the type of particle transport system which could be used in either environment.

The ferrous particulate matter magnetically drawn away from the copy sheet is then intercepted and collected. There is provided a receiver preferably in the form of an endless conveyor 28 or 30 associated with each magnet. Each of the conveyors 28, 30 passes between its magnet and the paper moving along the paper path 16.

Referring to magnet 22 and its associated conveyor 28, the conveyor 28 includes a textured surface 32. As the particulate matter 26 is drawn by the magnet to the conveyor 28, the textured surface 32 engages the particulate matter and serves to move it along with the conveyor.

The ferrous particulate matter intercepted and collected by the receiver is then transported to a predetermined location. As one portion of the conveyor 28 is moved out of the magnetic field, another portion is moved into the magnetic field to continue the interception and collection of the ferrous particulate matter.

In FIG. 1, conveyor 28 moves the particulate matter through the magnetic field, out of the magnetic field and in the direction shown by the arrow 34. During the horizontal run of the conveyor, and partially through the curved path extending about the rollers 33, 35, the magnetic field of the magnet 22 is strong enough to hold the particles 26 to the belt. From the roller 35 to the roller 38, the textured surface 32 serves to hold the particles 26 on the belt.

As the particles are transported angularly upwardly by the belt 28 (i.e. as the belt travels from roller 35 to roller 38), the textured surface 32 serves to resist downward sliding of the particles on the belt under the influence of gravity. An iron shield 36 on the upper portion of the magnet substantially reduces the strength of the magnetic field on the particles moving on the angularly upwardly traveling path of the belt. This prevents any particles from sliding back on the belt due to the effect of the magnet. Once the particles are carried over the roller 38, the orientation of the belt 28 permits them to fall, under the influence of gravity, into a collecting tray 40. This tray is removed when filled, and is replaced with another tray without disrupting the continuous removal of ferrous particulate matter from the paper by the magnet 22 and the belt 28.

The operation of the belt 30 and the magnet 24 on the underside of the paper moving along the paper path 16 is substantially similar. The magnetic field of magnet 24 is strong enough to draw ferrous particulate matter from the paper to the belt 30. Belt 30 includes a textured surface 42 which serves to move the ferrous particulate matter through and out of the magnetic field. Belt 30 is designed so that shortly after the ferrous particulate matter is moved out of the magnetic field, it is permitted to move relative to the belt under the influence of gravity and thus fall into the receiving tray 44. The tray 44 may be replaced with a new tray when filled, without disrupting the continuous removal of ferrous particulate matter from the paper. There is provided a magnetic shield 46 on the underside of the magnet 24 which serves to prevent the field of the magnet 24 from interfering with the gravity drop of the particles 26.

While the arrangement of the belt 30 is shown as merely conveying the particles to a gravity drop position at the end of the magnet, it will be readily appreciated that if for any reason machine design requires it, a substantial horizontal component of movement of the particles can be provided for in a manner analogous to that illustrated for the belt 28.

Thus, according to the present invention, there is provided a novel method and apparatus for removing particulate ferrous matter from an element which is moving between stations in an electrostatic copier. With the foregoing disclosure in mind, many and varied obvious modifications of the principles of this invention will become readily apparent to those of ordinary skill in the art.

Therefore, what is claimed is:

1. In an electrostatic copier having means for transporting, along a predetermined path, an element whose surface bears an image of electrostatic toner particles and residual ferrous carrier particles, resulting from treatment by an electrostatic developer of the magnetic brush type, the improvement comprising:

magnet means arranged adjacent said predetermined path for creating a magnetic field around a portion of said element, as the same is being transported along said path, for drawing ferrous particulate matter away from said element;

receiving means at a discharge location;

means for intercepting and collecting ferrous particulate matter drawn from the element towards the magnet means, for conveying the ferrous particulate matter thus collected to the vicinity of said receiving means and for releasing the ferrous particulate material at said receiving means, said means for intercepting, conveying and releasing comprising:

a continuous flexible belt passing between the element and the magnet and having textured surface oriented away from the magnet and towards the element when lying between the same;

guide and support means for the belt; and means for driving the belt in its path about said guide and support means.

* * * * *